US009436160B2

(12) United States Patent
Robin

(10) Patent No.: US 9,436,160 B2
(45) Date of Patent: Sep. 6, 2016

(54) CHARACTER DISPLAY MECHANISM FOR A TIMEPIECE

(71) Applicant: Blancpain S.A., Le Brassus (CH)

(72) Inventor: Martin Robin, Lausanne (CH)

(73) Assignee: Blancpain S.A., Le Brassus (CH)

( * ) Notice: Subject to any disclaimer, the term of this patent is extended or adjusted under 35 U.S.C. 154(b) by 0 days.

(21) Appl. No.: 14/930,862

(22) Filed: Nov. 3, 2015

(65) Prior Publication Data

US 2016/0124385 A1 May 5, 2016

(30) Foreign Application Priority Data

Nov. 5, 2014 (EP) ..... 14191898

(51) Int. Cl.

| | |
|---|---|
| ***G04B 19/20*** | (2006.01) |
| ***G09F 9/37*** | (2006.01) |
| ***G09F 9/46*** | (2006.01) |
| *G04B 19/247* | (2006.01) |

(52) U.S. Cl.

CPC ..... *G04B 19/202* (2013.01); *G04B 19/247* (2013.01); *G09F 9/37* (2013.01); *G09F 9/46* (2013.01)

(58) Field of Classification Search

CPC .. G04B 19/20; G04B 19/202; G04B 19/247; G09F 9/37; G09F 9/46

USPC ..... 368/37, 77, 233

See application file for complete search history.

(56) References Cited

U.S. PATENT DOCUMENTS

| | | | | |
|---|---|---|---|---|
| 3,831,303 | A * | 8/1974 | Funaki | G04B 19/207 235/117 R |
| 3,977,179 | A | 8/1976 | Bachmann | |
| 4,164,824 | A * | 8/1979 | Nidelkoff | G09F 9/37 40/450 |
| 4,178,752 | A * | 12/1979 | Umezaki | G04C 17/00 345/109 |

(Continued)

FOREIGN PATENT DOCUMENTS

| | | |
|---|---|---|
| CH | 589 881 B5 | 7/1977 |
| DE | 464 349 | 8/1928 |

(Continued)

OTHER PUBLICATIONS

European Search Report issued Sep. 4, 2015 in European Application 14191898, filed on Nov. 5, 2014 ( with English Translation).

*Primary Examiner* — Vit W Miska

(74) *Attorney, Agent, or Firm* — Oblon, McClelland, Maier & Neustadt, L.L.P.

(57) ABSTRACT

The character display mechanism for a timepiece includes a first indicator member disposed underneath a mask and arranged to rotate in steps about an axis, the first indicator member bearing a series of intertwined figures distributed over a circular track, the mask including a display area having a plurality of first openings, the figures being intended to appear successively through the first openings during the rotation of the first indicator member, and the first openings being disposed such that only one figure at a time appears in the display area. The first indicator member is pierced with second openings, said second openings being arranged to stop directly underneath one of said first openings during the step-by-step rotation of the first indicator member. The display mechanism includes a second indicator member at least partially superposed on the first indicator member in the display area. The second indicator member bears a pattern comprising segments.

9 Claims, 7 Drawing Sheets

(56) References Cited

U.S. PATENT DOCUMENTS

| | | | | |
|---|---|---|---|---|
| 7,821,879 | B2 * | 10/2010 | Buttet | G04B 19/202 368/220 |
| 8,218,400 | B2 * | 7/2012 | Taylor | G04B 19/00 368/221 |
| 2003/0099159 | A1 * | 5/2003 | Herbstman | G04B 19/202 368/77 |
| 2008/0137487 | A1 | 6/2008 | Buttet et al. | |

FOREIGN PATENT DOCUMENTS

| | | |
|---|---|---|
| DE | 93 19 908 U1 | 2/1994 |
| WO | WO 2006/024311 A1 | 3/2006 |

* cited by examiner

CHARACTER DISPLAY MECHANISM FOR A TIMEPIECE

This application claims priority from European Patent Application No. 14191898.7 filed Nov. 5, 2014, the entire disclosure of which is hereby incorporated herein by reference.

FIELD OF THE INVENTION

The present invention concerns a character display mechanism for a timepiece including an indicator member arranged underneath a mask and arranged to rotate in steps about an axis perpendicular to the mask, the indicator member bearing a series of intertwined figures distributed over a circular track, the mask including a display area exhibiting a plurality of openings. The figures are intended to appear successively through the openings in the mask during the rotation of the indicator member, and the openings are arranged to reveal only one figure at a time in the display area.

PRIOR ART

Most known character display mechanisms for timepieces include the combination of a window, i.e. an opening of dimensions corresponding to those of the indications to be displayed, made in the timepiece dial, and a rotating disc which bears a series of indications to be displayed, these indications being marked one next to the other on a circular track passing underneath the window when the indicator member rotates. This display system is very widely used, for example in calendar-watches. It is also used, for example, in jumping-hour mechanical watches in which a disc replaces the hour hand so that a numeral is displayed in a window and then disappears at the change to the next hour. The digital display of jumping hours requires rotation of a disc bearing the series of the 12 or 24 numerals to be displayed. This can provide static numerals unlike a continuous digital display.

A shared flaw of most display mechanisms which meet the above description is the small size of the displayed indications. Indeed, to avoid adjacent indications overlapping, the various symbols must each be contained in a distinct sector of the indicator disc. In these conditions, it will be understood that the opening of a sector is limited to the angle obtained by dividing 360° by the number of indications distributed around the disc. In the case, for example, where the indications are the series of numerals from 1 to 31, it can be calculated that the opening of the sectors is slightly less than 12°.

There are known character display mechanisms which propose to overcome the above limitation. CH Patent No 589881 in particular, describes a digital display mechanism which conforms to the definition given in the preamble. This mechanism includes, in a conventional manner, a disc arranged to rotate in steps underneath a fixed dial. The periphery of the disc bears numerals or pairs of numerals arranged to be displayed in succession in a window provided in the dial. A peculiarity of this known display mechanism is that the numerals marked on the disc encroach on each other due to their large size. Further, contrary to what is normally the case, rather than being formed by a simple aperture made in the dial, the window of this known display mechanism is formed by a mask comprising a series of openings distributed over a line which corresponds to the superposition of the numerals to be displayed successively. According to the aforementioned prior document, two indications that encroach on each other are tilted with respect to each other and the openings in the window are oriented such that, for each angular position of the display disc, only one indication appears in the window. It will be understood that the mechanism that has just been described allows for the display of indications of larger size.

BRIEF SUMMARY OF THE INVENTION

It is an object of the present invention to further increase the size of the indications that can be displayed by means of a character display mechanism for a timepiece. The present invention achieves this object by providing character display mechanism conforming to the annexed claim 1.

It will be understood that, as with known character display mechanisms, the mechanism of the invention is arranged to display each character or group of characters by means of one of the figures borne by the first display member. However, according to the invention, some of the figures borne by the first indicator member are associated with second openings through the first indicator member. As a result of this feature and the presence of a second indicator member, the mechanism of the invention can complete a figure carried by the first indicator member by adding thereto one or more segments borne by the second indicator member. Thus, depending on whether a figure appears in the display area alone, or conversely, in combination with one or more segments, the same figure can be used for the display of several different characters. As a result of this feature, it is therefore possible to display the set of characters or groups of characters required to be displayed by means of a reduced number of figures. One advantage of having fewer figures distributed on the circular track of the first indicator member is that it is possible to further increase the size of each figure.

BRIEF DESCRIPTION OF THE DRAWINGS

Other features and advantages of the invention will appear upon reading the following description, given solely by way of non-limiting example, with reference to the annexed drawings, in which.

DETAILED DESCRIPTION OF EMBODIMENTS

Figure 1:
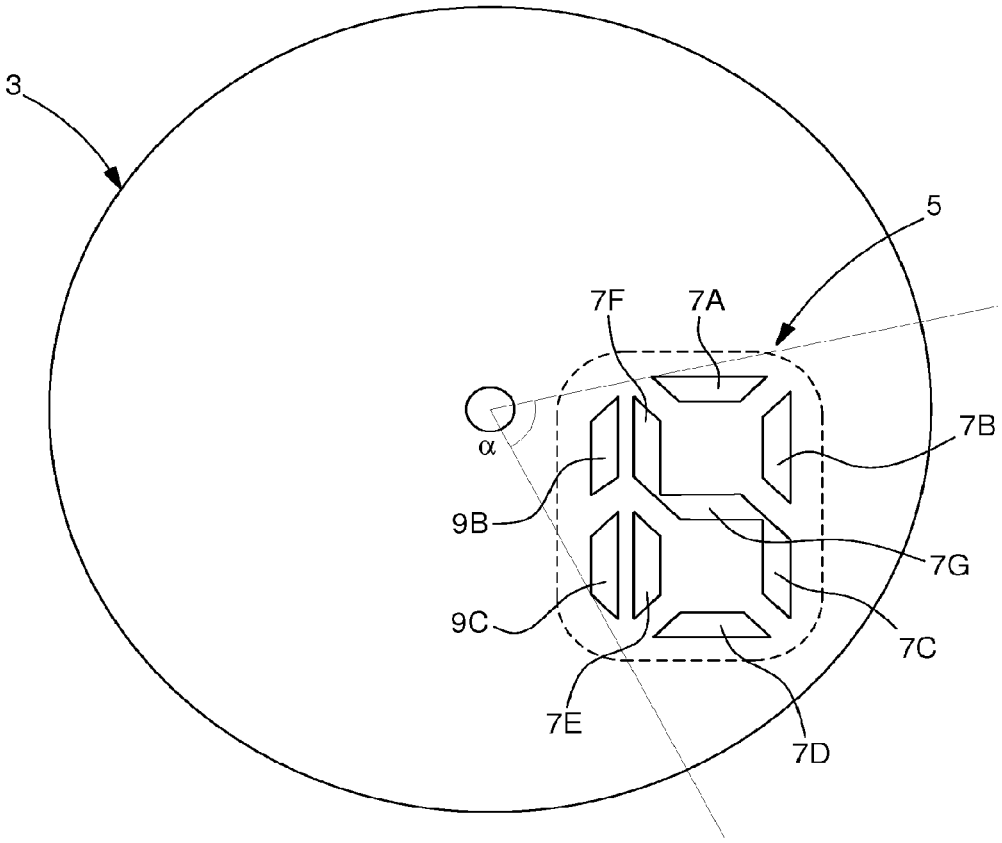
FIG. 1 is a top plan view of the dial of a timepiece equipped with a jumping hour display mechanism according to a first embodiment of the invention.

FIG. 1 is a top view of the dial of a timepiece equipped with a jumping-hour mechanism according to a first embodiment of the invention. It should be recalled that timepieces of this type include a digital display instead of the usual hour hand. It can be seen in the Figure that, in the illustrated embodiment, openings (referenced 7A to 7G and 9B and 9C) are arranged in a display area 5 of the circular timepiece dial 3. It can also be seen that the openings arranged in the display area are formed of rectilinear segments which are nine in number and which together form a representation of the numeral "18". In fact, the numeral "18" corresponds to the superposed outlines of all the numerals from "1" to "12" as they are represented in the present example.

Referring again to FIG. 1, it can be seen that the seven segments referenced 7A to 7G together form an "8", and that the last two segments, referenced 9B and 9C, form a "1". It will be understood that the display mechanism described can depict each of the numerals from "0" to "9" using segments 7A to 7G, and that the mechanism uses the two segments 9B and 9C to depict the numeral "1" to represent the ten in the numerals "10", "11" and "12". It is specified that the main display that has just been described is known per se. It falls into the category of so-called seven segment displays. Seven segment displays can form all the numerals from "0" to "9" using a sub-assembly drawn from 7 rectilinear segments (four vertical segments and three horizontal segments). Finally, it will also be understood from the above description that, in the present example, it is dial 3 of the timepiece that forms the mask according to the invention. It was stated above that it is an object of the present invention to provide a character display mechanism wherein the characters may have a larger size. The digital 12-hour display mechanism that forms the subject of the present example achieves this object in a spectacular fashion. Indeed, with a jumping-hour display mechanism of the prior art, the twelve numerals to be displayed must each be contained in a distinct sector of the indicator disc. In these conditions, it is calculated that the opening of a sector should normally not exceed 30°. It can be verified in FIG. 1 that the angular opening of the sector occupied by the displayed numeral (referenced $\alpha$) is 76°.

In addition to dial 3, the jumping-hour display mechanism of the present example includes a first and a second display member arranged underneath the dial and arranged to rotate in steps about an axis perpendicular to the dial. These two indicator members respectably form the subject of the top plan views of FIGS. 2A and 2B. The indicator members of FIGS. 2A and 2B are intended to be arranged in a superposed position in the jumping-hour display mechanism, with the first indicator member extending between dial 3 and the second indicator member. Referring simultaneously to the two preceding Figures, and to the top view of FIG. 2C, it can be seen that the angular position of the indicator members in FIGS. 2A and 2B corresponds to indication of the numeral "1".

Referring now more particularly to FIG. 2A, it can be seen that the contour of the first indicator member is made irregular by the presence of cutouts (referenced 13*a* and 13*b*). It is acknowledged however, that, apart from these cutouts, the general shape of the indicator has rotational symmetry of order 8. It can also be seen that the indicator member bears a series of eight figures which are distributed, concentrically to the axis of rotation, over a wide circular track. It will be noted that the figures encroach on each other, and that two overlapping figures are tilted relative to each other. Finally it will be noted that, in the illustrated example, the figures borne by the first indicator are presented in a dark colour on a white background, and that the mask is also white.

Figure 2C:
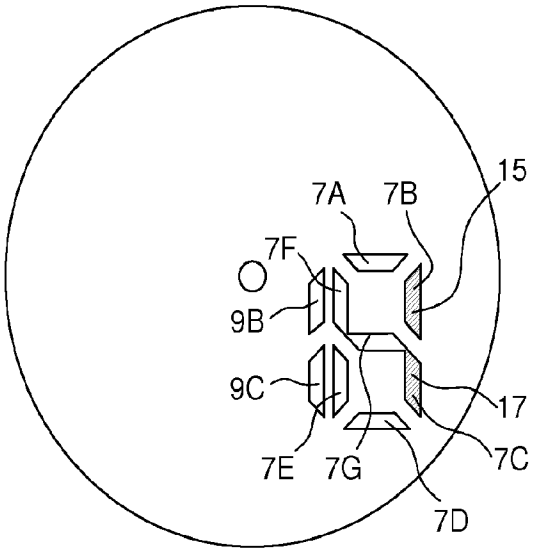
FIGS. 2A, 2B and 2C are top plan views respectively showing the first indicator member, the second indicator member and the mask of the jumping hour display mechanism of FIG. 1. The two indicator members are shown in an angular position corresponding to indication of the numeral "1".
Figure 2B:
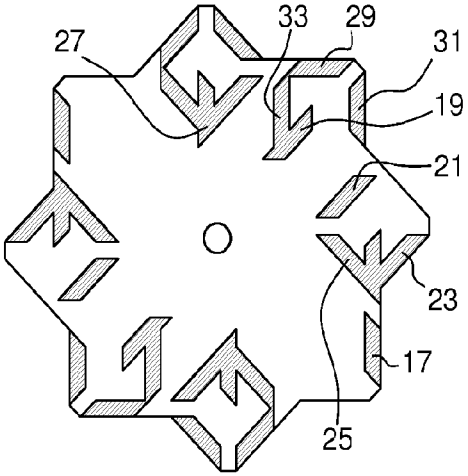
Figure 2A:
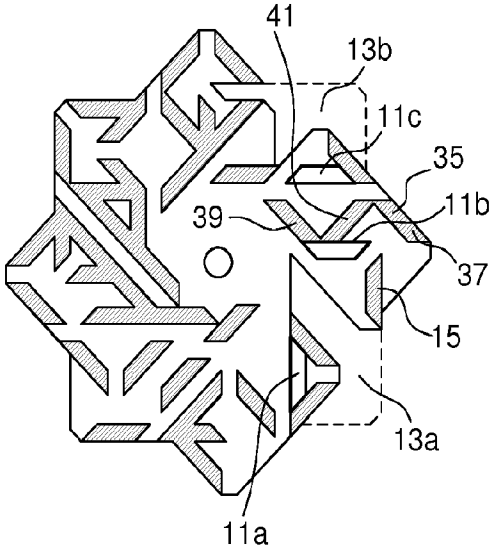

Referring simultaneously to FIGS. 2A and 2C, it will be understood that the openings in the window are oriented such that two figures can overlap without simultaneously appearing through the mask. It will also be observed that, in the present example, the figures are arranged to intersect at the ends of the segments, or in other words, to cross each other outside the portions of the segments intended to appear through the openings in the mask. In the illustrated example, two figures that overlap are tilted at exactly 45° with respect to each other. Further, in the present example, the four vertical segments 7B, 7C, 7E and 7F and the three horizontal segments 7A, 7D, and 7G of the seven segment display are not tilted, but form an angle of exactly 90° between them. In these conditions, for the figures to intersect at the segment ends, the horizontal segments and the vertical segments must be of the same length. It will be understood, however, that if the tilt angle were not equal to 45°, the horizontal segments and the vertical segments of the seven segment display would preferably have different lengths.

Referring again to FIG. 2A, it can be seen that the first indicator member is pierced with a certain number of openings (which will be referred to hereafter as 'second openings'). These second openings are of two types. There are first of all holes (referenced 11*a*, 11*b* and 11*c*), which are made in the indicator plate, and there are also cutouts 13*a* and 13*b*. In the example shown, holes 11*a*, 11*a* and 11*c* all have an identical shape to that of the first openings 7A to 7G and 9B, 9C made in the mask. It will be understood however that according to other embodiments, this is not necessarily the case. Indeed, the holes may be considerably larger than those of the mask, since they are still at least partially concealed by the mask. It will also be noted that, in the illustrated embodiment, cutouts 13*a* and 13*b* are larger than the openings in the mask.

Referring now to FIG. 2B, it can be seen that, in the illustrated embodiment, the shape of the second indicator member has the same rotational symmetry of order 8 as the first indicator member. It can also be observed that the second indicator member bears a pattern created in the same dark colour as the figures borne by the first indicator member. Further, the pattern is also presented on a white background. It can also be seen that the pattern includes segments that are oriented in the same four directions (horizontal, vertical, oblique to the left, oblique to the right) as the segments which form the eight figures borne by the first indicator member.

The jumping-hour display mechanism of the present example is devised to display the series of numerals from "1" to "12" using an indicator member bearing a series of exactly eight figures and which is arranged to rotate in 45° jumps. The operation of this mechanism will now be described. As already noted, the angular positions in which the two indicator members are shown in FIGS. 2A and 2B are associated with the display of the numeral "1". A careful examination of FIGS. 2A and 2C reveals that, in the configuration shown, the figure borne by the first indicator member which is visible through the mask is formed of a single dark-coloured segment referenced 15. It will be understood that the colour of this segment contrasts with that of the mask. The segment is thus clearly visible through opening 7B in the mask. It was also seen that the figures borne by the first indicator are presented on a white background. Since the mask and the background of the same colour, when a portion of the white background is directly underneath an opening in the mask, the effect is to conceal the opening. In the configuration shown, the first openings 9B and 9C of the mask are thus concealed.

It was seen that, according to the invention, the first indicator member also includes second openings arranged to stop directly underneath one of said first openings during the step-by-step rotation of the first indicator member. In the configuration shown, three second openings are stopped directly underneath a first opening. These are holes 11*a* and 11*b* which are respectively placed directly underneath first openings 7E and 7A and cutout 13*a* which extends underneath the entire surface occupied by the first openings 7C, 7D, 7F and 7G. In other words, in the configuration shown in FIGS. 2A, 2B and 2C, six of the seven first openings of the portion of the mask used to display the units, are directly superposed on second openings.

A further careful examination of FIG. 2B reveals that a single segment (referenced 17) of the dark-coloured pattern borne by the second indicator member is visible through the mask. It will be understood that, in the configuration shown, second opening 13*a* of the first indicator member and segment 17 which is borne by the second indicator member are both stopped directly underneath first opening 7C. It will also be understood that the colour of segment 17 contrasts with that of the mask. The segment is thus clearly visible through the superposed openings 13*a* and 7C. Further, it was also seen that the pattern borne by the second indicator member is presented on a white background. Since the mask and the background are of the same colour, when a portion of the white background is directly underneath an opening in the mask, the effect is to conceal the opening. In the configuration shown, it will be understood that it is the first openings 7A, 7D, 7E, 7F and 7G of the mask which are thus concealed by the white background visible through the second openings 11*a*, 11*b* and 13*a*.

According to the invention, the character display mechanism makes it possible to complete a figure borne by the first indicator member by adding thereto one or more segments borne by the second indicator member. As has just been seen, in the embodiment which is the subject of the present example, the display mechanism can indicate the numeral "1" by associating segment 17, which is borne by the second display member, with FIG. 15 (in other words segment 15) which is borne by the first display member. It will also be understood that segment 17 and segment 15 together form a representation of the numeral "1".

Figure 3A:
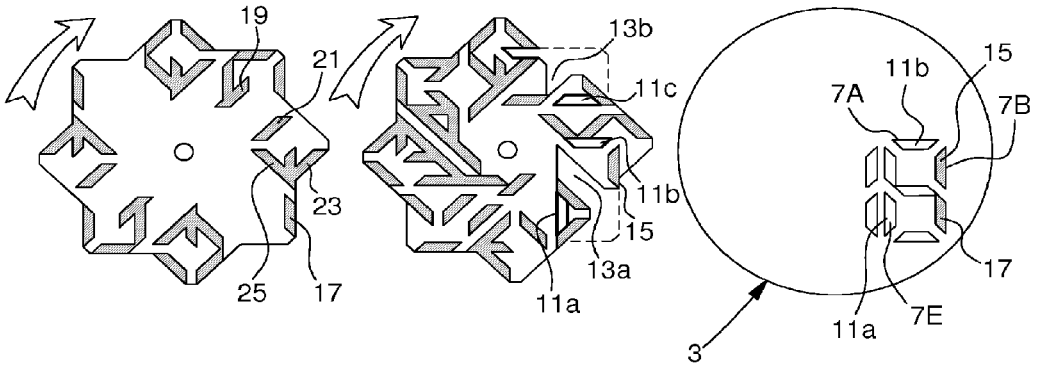
FIG. 3A includes a first view reproducing the second indicator member as shown in FIG. 2B, the second view reproducing the first indicator member as shown in FIG. 2A, and a third view reproducing the mask as shown in FIG. 2C.
Figure 3B:
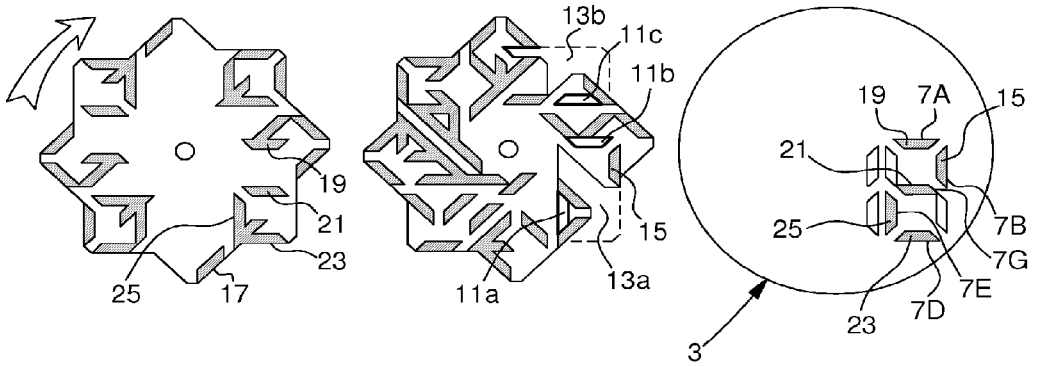
FIGS. 3B to 3L each include 3 similar views to those of FIG. 3A and also show the first indicator member, the second indicator member and the mask. Each of FIGS. 3B to 3L shows the two indicator members in different angular positions; the different angular positions respectively correspond to indication of the numerals "2" to "12".

The twelve FIGS. 3A to 3L illustrate how each numeral of the series from "1" to "12" appears in succession in the display area of dial 3, and then disappears at the change to the next hour. FIG. 3A includes a first view reproducing the second indicator member as shown in FIG. 2B, the second view reproducing the first indicator member as shown in FIG. 2A, and a third view reproducing the mask as shown in FIG. 2C. FIG. 3B is similar to FIG. 3A. However, it shows the two indicator members in a different configuration, which corresponds to an indication of the numeral "2". A careful examination of the indicator members shown in FIGS. 3A and 3B reveals that there is no change in the angular position of the first indicator member between FIG. 3A and FIG. 3B. Conversely, it is noted that, in FIG. 3B, the second indicator member has undergone a 45° rotation in the clockwise direction relative to its angular position in FIG. 3A. It will be understood that the effect of this rotation is to substitute the indication of the numeral "2" for that of the numeral "1".

As the first indicator member is in the same angular position in FIG. 3B as in FIG. 3A, the figure of the first indicator member which is visible through opening 7B of the mask is still the dark-coloured segment referenced 15. Further, the portions of the first indicator that are visible through first openings 9B and 9C of the white mask are background portions, which are also white. In these conditions, openings 9B and 9C are practically invisible. Finally, the remaining first openings (7A, 7C, 7D, 7E, 7F, and 7G) are each directly superposed on one of the second openings 11*a*, 11*b* or 13*a*.

It can also be seen in FIG. 3B that four segments (referenced 19, 21, 23 and 25), which form part of the dark-coloured pattern borne by the second indicator member, are visible through the mask. It will be understood that, in the configuration shown, segment 25 which is borne by the second indicator member and the second opening 11*a* are both stopped directly underneath first opening 7E. Likewise, segment 19 and second opening 11*b* are both stopped directly underneath first opening 7A. Segments 19 and 25 are thus visible respectively through first openings 7A and 7E. Finally, segments 21 and 23 which are borne by the second indicator member are respectively stopped underneath first openings 7G and 7D. Further, cutout 13*a* extends between the second indicator member and the mask underneath the entire surface occupied by first openings 7G and 7D. Segments 21 and 23 are thus also visible through the mask. Finally, it will be understood that first openings 7C and 7F of the mask are concealed by the white background of the second indicator member. In fact, cutout 13*a* also extends under the surface occupied by first openings 7C and 7F. These two first openings are thus concealed by the white background of the second indicator member.

Figure 3C:
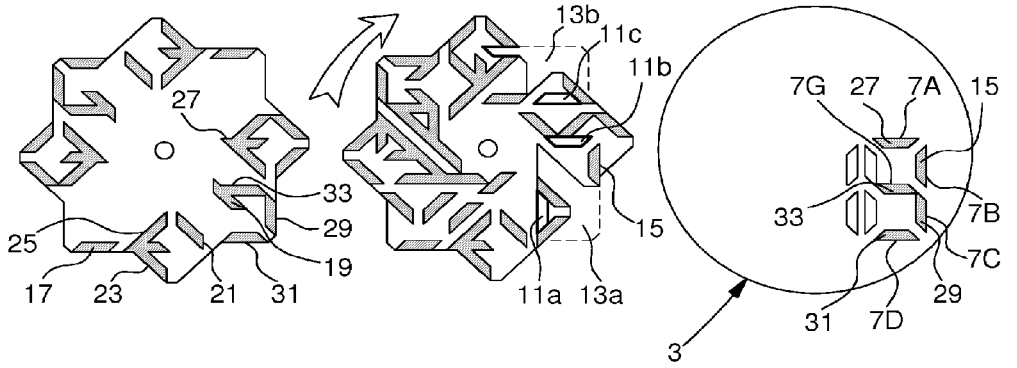

FIG. 3C is similar to FIGS. 3A and 3B. However, it shows the two indicator members in a different configuration, which corresponds to an indication of the numeral "3". A careful examination of the indicator members shown in FIGS. 3B and 3C reveals that there is no change in the angular position of the first indicator member between FIG. 3B and FIG. 3C. Conversely, it is noted that, in FIG. 3C, the second indicator member has undergone another 45° rotation in the clockwise direction relative to its angular position in FIG. 3B. It will be understood that the effect of this rotation is to substitute the indication of the numeral "3" for that of the numeral "2".

As the first indicator member is in the same angular position in FIG. 3C as in FIG. 3B, the figure of the first indicator member which is visible through opening 7B of the mask is still the dark-coloured segment referenced 15. Further, the portions of the first indicator that are visible through first openings 9B and 9C of the white mask are background portions, which are also white. In these conditions, openings 9B and 9C are practically invisible. Finally, the remaining first openings (7A, 7C, 7D, 7E, 7F, and 7G) are each directly superposed on one of the second openings 11*a*, 11*b* or 13*a*.

It can also be seen in FIG. 3C that four segments (referenced 27, 29, 31 and 33), which form part of the dark-coloured pattern borne by the second indicator member, are visible through the mask. It will be understood that, in the configuration shown, segment 27 which is borne by the second indicator member and the second opening 11*b* are both stopped directly underneath first opening 7A, through which segment 27 is visible. Segments 29, 31 and 33 which are borne by the second indicator member are respectively stopped underneath first openings 7C, 7D and 7G. Further, cutout 13*a* extends between the second indicator member and the mask underneath the entire surface occupied by these three first openings. Segments 29, 31 and 33 are thus also visible through the mask. Finally, it will be understood that first openings 7E and 7F of the mask are concealed by the white background of the second indicator member. In fact, cutout 13*a* also extends underneath the surface occupied by first opening 7F and second opening 11*a* extends underneath first opening 7E. These two first openings are thus concealed by the white background of the second indicator member.

Figure 3D:
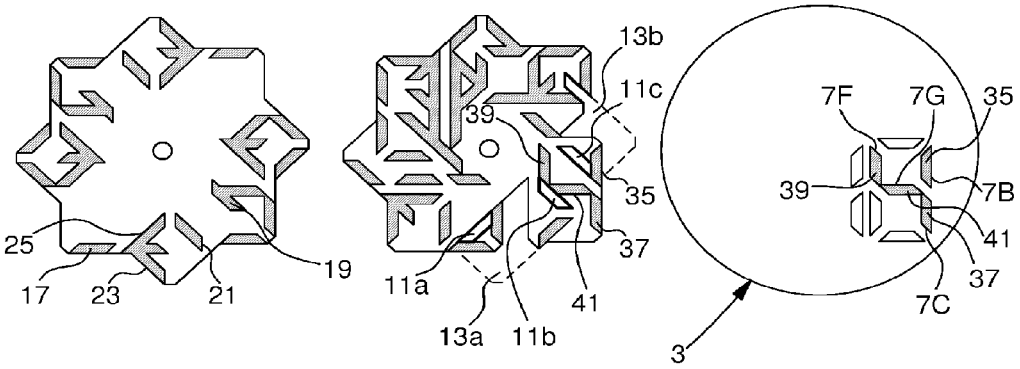
Figure 3E:
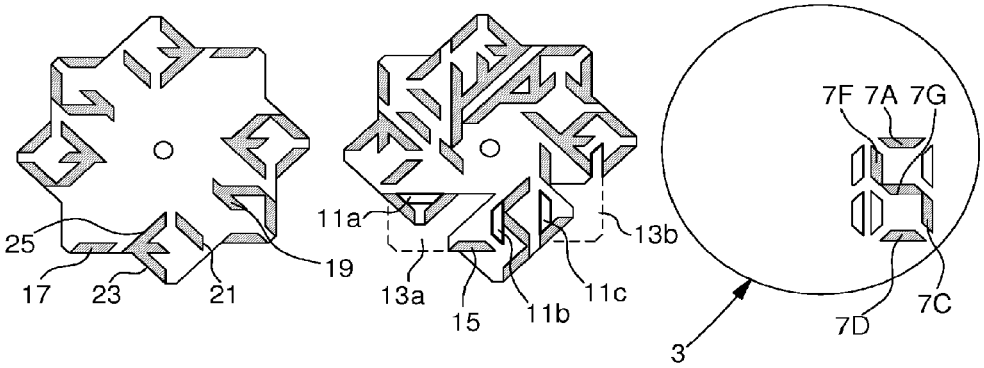
Figure 3F:
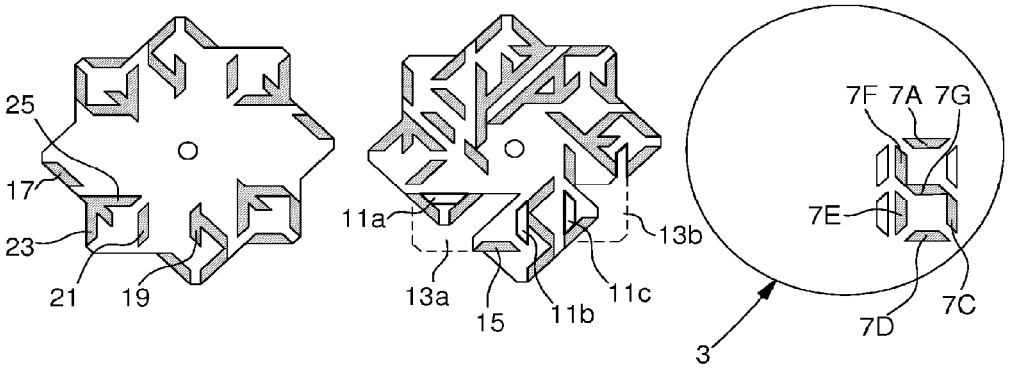
Figure 3G:
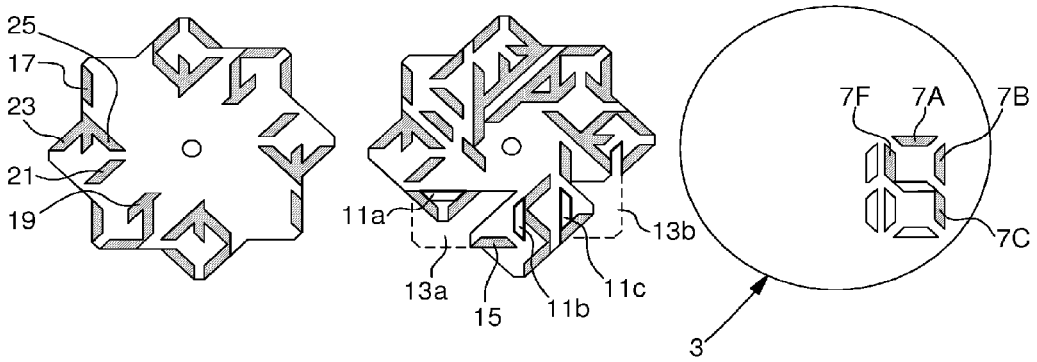
Figure 3H:
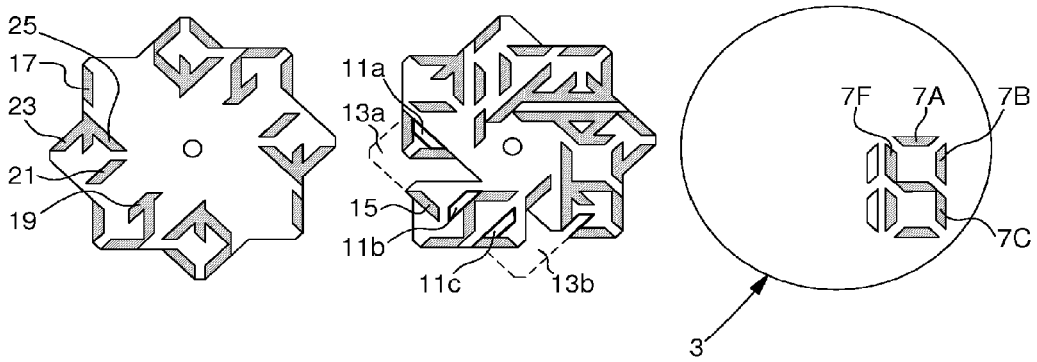
Figure 3I:
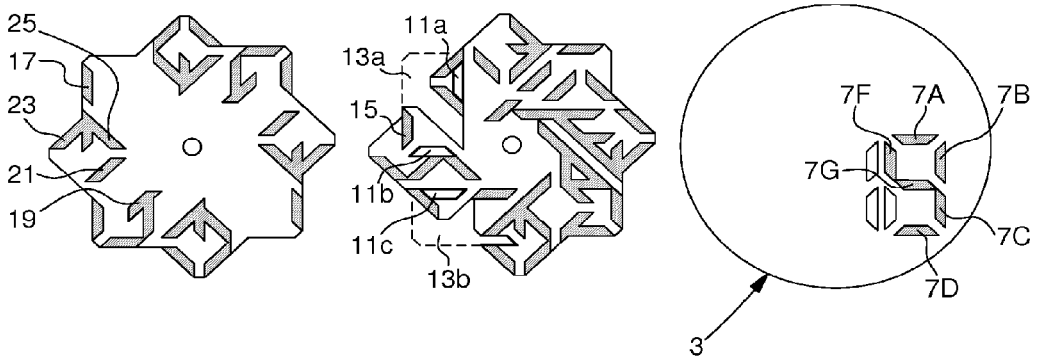
Figure 3J:
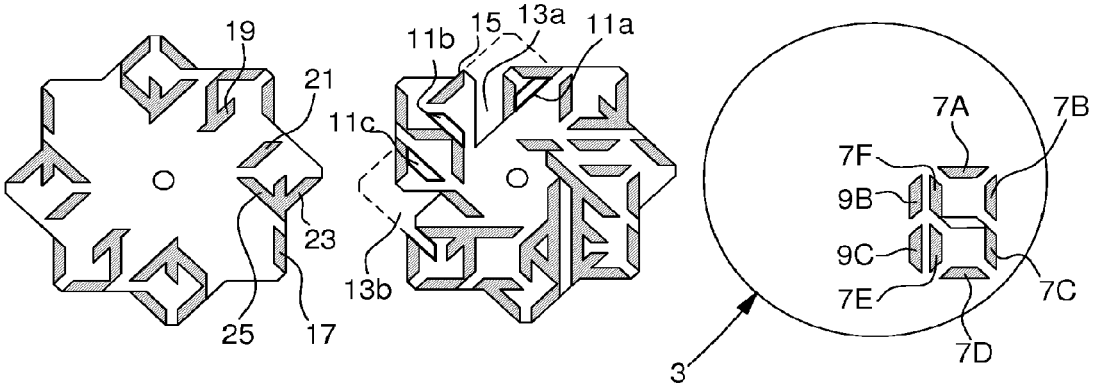
Figure 3K:
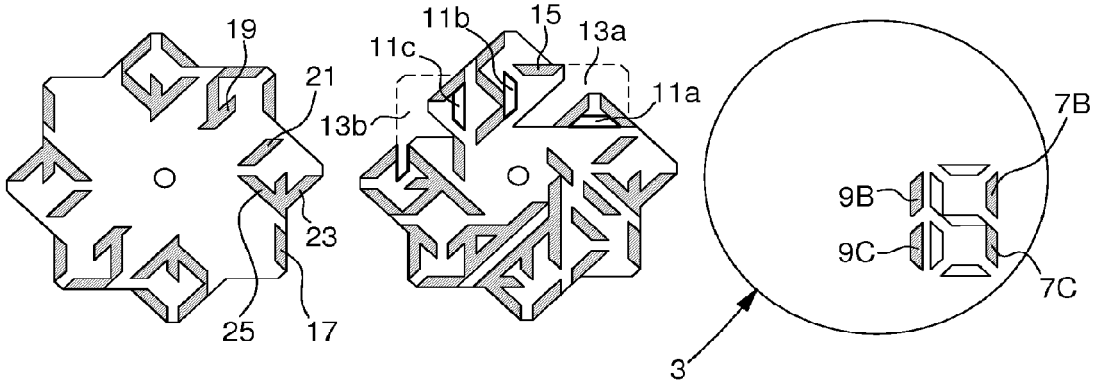
Figure 3L:
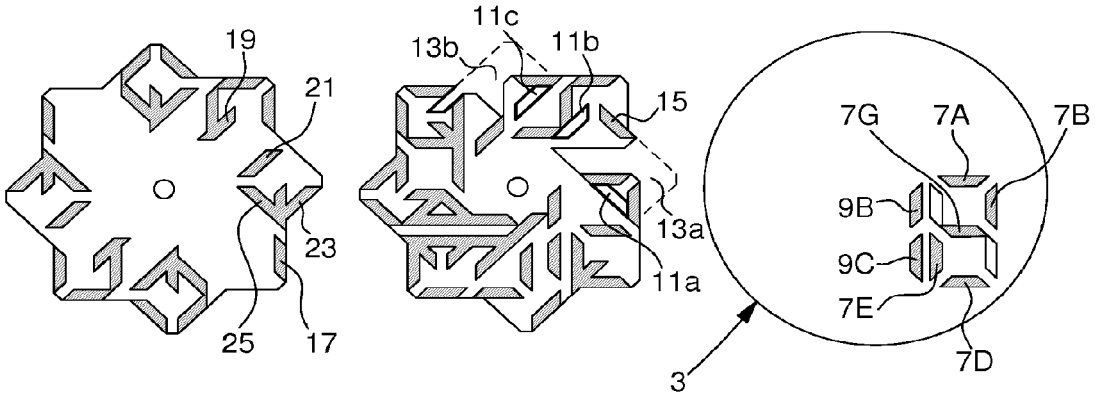

It will be understood from the foregoing that, according to the present example, the three characters "1", "2", and "3" are depicted using the same figure (segment 15) borne by the first indicator member. Conversely, if the configuration of the indicator members shown in FIGS. 3C and 3D are compared, it can be seen that, in FIG. 3D, the first indicator member has undergone a first 45° rotation in the clockwise direction relative to its angular position in FIG. 3C. An examination of the first indicator member in its new angular position and reference to the mask reveals that, in the configuration shown, the figure borne by the first indicator member that is visible through the mask is no longer the same. The new figure visible through the mask is formed by the four segments 35, 37, 39 and 41, which are respectively visible through first openings 7B, 7C, 7F, and 7G and together form the numeral 4. It will be understood that the effect of this rotation is to substitute the indication of the numeral "4" for that of the numeral "3".

Further, the portions of the first indicator that are visible through first openings 7A, 7D, 7E and 9B of the white mask are portions of white background. In these conditions, these first openings are practically invisible. Finally, the last first opening (referenced 9C) is superposed on the second opening 13*a*. It will therefore be understood that first opening 9C of the mask is concealed by the white background of the second indicator member.

In a similar manner to that explained above, another 45° rotation of the first indicator member has the effect of substituting the indication of the numeral "5" for that of the number "4". Next, a rotation of the second indicator member has the effect of substituting the indication of the "6" for that of the "5". Another rotation of the second indicator member then has the effect of substituting the indication of the "7" for the "6". Finally, six successive rotations of the first indicator member cause the indications "8", "9", "10", "11", "12" to appear in succession and finally once more the indication "1". Thus, a complete 12-hour cycle is associated with 8 jumps of the first indicator member and with 4 jumps of the second indicator member. It will be noted however, that the second indicator member thus only completes one half-turn per 12-hour cycle. This is why the pattern borne by the second indicator member has rotational symmetry of order 2. Alternatively, for example, a second indicator member advancing in 90° steps could have been used.

Figure 4:
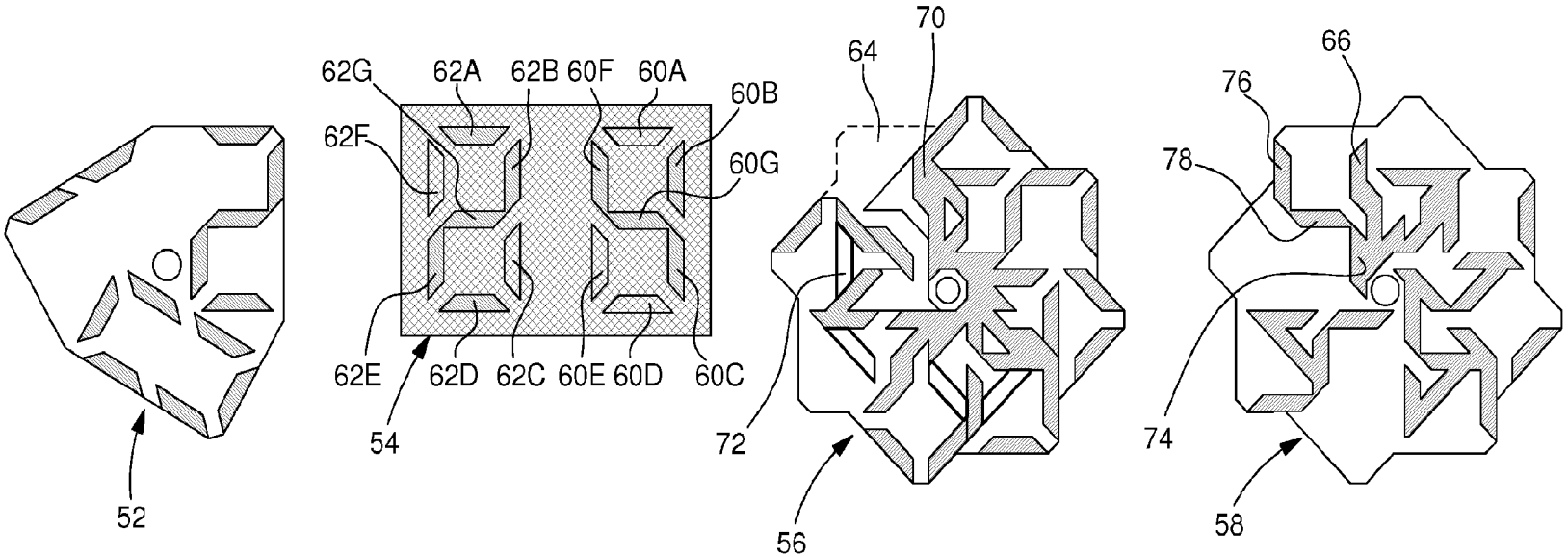
FIG. 4 includes four top plan views respectively showing, from left to right, the tens indicator member, the display area of the mask, and the first and second units indicator members of a jumping hour display mechanism which conforms to a second embodiment of the invention. The three indicator members are shown in angular positions corresponding to indication of the numeral "24".

FIG. 4 shows a jumping-hour display mechanism according to a second embodiment of the invention. A first difference between this embodiment and that forming the subject of the first example is that it is a 24-hour display instead of a 12-hour display. A second difference is that this second mechanism includes means for displaying the tens number that are independent from the means for displaying units number. FIG. 4 is an exploded view which shows, from left to right, a tens indicator member 52, the mask display area 54, the first 56 and second 58 indicator members forming part of the units indicator means of the jumping-hour display mechanism.

It can be seen in FIG. 4 that the mask display area 54 is pierced with openings 60A to 60G and 62A to 62G. It can also be seen that the openings provided in the display area are formed of rectilinear segments which are fourteen in number and which together form a representation of the numeral "88". It will be understood that openings 60A to 60G form part of a seven-segment display of the units number, and that openings 62A to 62G form part of a seven-segment display of the tens number. The actual display means of the seven-segment display of the tens number are independent of those of the seven-segment display of the units number.

Referring again to FIG. 4, it can be seen that the means for displaying the tens number include an indicator member 52 having three positions which is arranged to rotate underneath the mask. Indicator member 52 bears the three numbers 0, 1 and 2 spaced at an angle of 120°. It will be understood that indicator member 52 is arranged to advance in 120° steps so that the three tens numbers appear in succession through openings 62A to 62G of the mask.

According to the invention, the units number display means include a first display member 56 and a second display member 58 coaxially disposed underneath the dial and arranged to rotate in steps. It can be seen in FIG. 4 that the second indicator member 58 has a contour with rotational symmetry of order 8. If it were not for the presence of a cutout 64, the shape of the first indicator member 56 would also have the same rotational symmetry of order 8. It can also be seen that just like the first indicator member of the first embodiment, indicator member 56 of the present example bears a series of eight figures which are distributed, concentrically to the axis of rotation, over a wide circular track. It will be noted however that, in the present example, the figures are not the same as in the preceding example.

Referring again to FIG. 4, it can be seen that second indicator member 58 bears a pattern that includes segments which are oriented in the same four directions as the segments that form the eight figures borne by first indicator member 56. The means for indicating the units number of the jumping-hour display mechanism of the present example are devised to display the series of numerals from "0" to "9" using an indicator member bearing a series of exactly eight figures which is arranged to rotate in 45° jumps. In FIG. 4, the first and second indicator members are shown in angular positions that correspond to the display of the numeral "4". A careful examination of the drawing of indicator member 56 reveals that the figure borne by the first indicator member which is in the display zone is formed by a single light-coloured segment, which is referenced 70. When the first indicator member 56 is in the angular position shown, segment 70 is visible in the display area through opening 60B of the mask.

It was seen that, according to the invention, the first indicator member includes at least one second opening arranged to stop directly underneath one of said first openings. In the present example, two second openings are stopped directly underneath a first opening. These are a hole 72, which is stopped directly underneath first opening 60, and cutout 64 whose sinuous outline extends underneath the entire surface occupied by first openings 60A, 60C, 60D, 60F and 60G. It will be understood that, in the configuration of FIG. 4, six of the seven first openings of the portion of the mask used for the units display are directly superposed on second openings. An examination of the pattern borne by second indicator member 58 reveals that three dark-coloured segments 74, 76 and 78 are visible through cutout 64 and first openings 60C, 60F, and 60G of the mask. Together with segment 70, these segments form a representation of the numeral "4".

Those skilled in the art will understand that the operating principle of the jumping-hours mechanism of the present example is essentially the same as the operating principle of the mechanism of the first embodiment. The operation of the mechanism of the present example will not, therefore, be described any further.

It will also be clear that various alterations and/or improvements evident to those skilled in the art may be made to the embodiment described herein without departing from the scope of the present invention defined by the annexed claims. In particular, the figures borne by the first indicator could be formed of segments of the same colour as the mask, and presented on a background whose colour contrasts with that of the mask. Thus, when one segment of a figure is immobilised underneath an opening in the mask, the opening would be concealed. Conversely, when a portion of the background is directly underneath an opening in the mask, a segment would appear clearly through the opening. Further, those skilled in the art will understand that the invention is not limited to jumping-hour displays, but applies to all timepiece character displays.

What is claimed is:

1. A character display mechanism for a timepiece including a first indicator member disposed underneath a mask and arranged to rotate in steps about an axis, the first indicator member bearing a series of intertwined figures distributed over a circular track, the mask including a display area having a plurality of first openings, the figures being intended to appear successively through the first openings during the rotation of the first indicator member, and the first openings being disposed such that only one figure at a time appears in the display area;

wherein the first indicator member is pierced with second openings, said second openings being arranged to stop directly underneath one of said first openings during the step-by-step rotation of the first indicator member, wherein the display mechanism includes a second indicator member disposed underneath the mask and arranged to rotate in steps about an axis parallel to the axis of rotation of the first indicator member, the first indicator member and the second indicator member being at least partially superposed and the first indicator member extending between the mask and the second indicator member in the display area;

wherein the second indicator member bears a pattern including segments, one of said segments and one of said second openings being arranged to stop together directly underneath one of said first openings, so that said segment appears in the display area in combination with the figure visible at that moment, so as to form a character to be displayed.

2. The character display mechanism according to claim 1, wherein the mechanism is arranged to display different indications using same set of segments, the superposition of a set of indications to be displayed corresponding to the display of the complete set of segments.

3. The character display mechanism according to claim 2, wherein all the segments are line segments.

4. The character display mechanism according to claim 3, wherein the segments borne by the second indicator member are intertwined, and wherein one of the second openings has the shape of a segment.

5. The character display mechanism according to claim 3, wherein the mechanism is arranged to display the various indications using a standard set of seven segments or with a set of nine segments formed by a set of seven segments, for displaying a units number using the set of seven segments, in combination with two additional segments for displaying the numeral 1 before the units number.

6. The character display mechanism according to claim 5, wherein the various segments of the standard set of seven segments or of the set of nine segments are each oriented in one of two orientations (respectively horizontal and vertical) which are perpendicular to each other.

7. The character display mechanism according to claim 6, wherein the first indicator member is arranged to make eight steps per revolution about its axis, and wherein the series of intertwined figures borne by the first indicator member is formed of eight figures.

8. The character display mechanism according to claim 7, wherein the horizontally oriented segments and the vertically oriented segments have the same length, and wherein the intertwined figures intersect each other at the ends of the segments.

9. The character display mechanism according to claim 1, wherein the figures borne by the first indicator are presented in a first colour on a background of a second colour, with the colour of the mask being the second colour.

* * * * *